US007232112B2

(12) United States Patent
Foster

(10) Patent No.: US 7,232,112 B2
(45) Date of Patent: Jun. 19, 2007

(54) STAPLE REMOVING BIT ESPECIALLY FOR UPHOLSTERY

(76) Inventor: Danny Wayne Foster, 2513 Davis Rd., Fairbanks, AK (US) 99709

( * ) Notice: Subject to any disclaimer, the term of this patent is extended or adjusted under 35 U.S.C. 154(b) by 0 days.

(21) Appl. No.: 11/082,647

(22) Filed: Mar. 17, 2005

(65) Prior Publication Data

US 2006/0208243 A1 Sep. 21, 2006

(51) Int. Cl.
*B25C 11/00* (2006.01)

(52) U.S. Cl. ..... 254/28

(58) Field of Classification Search ..... 254/28, 254/25; 81/3.55, 489
See application file for complete search history.

(56) References Cited

U.S. PATENT DOCUMENTS

| | | | | |
|---|---|---|---|---|
| 838,987 | A * | 12/1906 | Nassau | 254/25 |
| 3,208,134 | A | 9/1965 | Krewson, Jr. | |
| 3,310,288 | A | 3/1967 | Berry | |
| 3,689,977 | A | 9/1972 | Crabbe | |
| 4,036,471 | A | 7/1977 | Allen | |
| 4,245,817 | A | 1/1981 | Peoples | |
| 4,293,119 | A | 10/1981 | Diedeerichs | |
| 4,637,538 | A | 1/1987 | Wagner | |
| 5,163,597 | A | 11/1992 | Napoli, Jr. | |
| D364,325 | S | 11/1995 | Jetter | |
| 5,495,651 | A | 3/1996 | Tsuha | |
| 5,707,377 | A | 1/1998 | Keller | |
| 5,722,141 | A * | 3/1998 | Strickland | 29/267 |
| D456,236 | S * | 4/2002 | Norton | D8/89 |
| D492,173 | S | 6/2004 | Huang | |
| D500,433 | S | 1/2005 | Klaas | |
| 6,976,405 | B2 * | 12/2005 | Schaeffer | 81/3.55 |
| 2005/0161647 | A1 * | 7/2005 | Buch et al. | 254/28 |

* cited by examiner

*Primary Examiner*—Lee D. Wilson
(74) *Attorney, Agent, or Firm*—Polster, Lieder, Woodruff & Lucchesi, L.C.

(57) ABSTRACT

A staple removing tool comprises a shaft having a working end at which opposed sloped surfaces are formed, such that shaft, in side elevation, the working end of the shaft substantially comes to a pointed end. A notch is formed in the forward end of the tool, and a slot extends rearwardly from the apex of the notch. The tool is rotated to remove staples from furniture and can be adapted to be received in an electric drill or screwdriver.

13 Claims, 1 Drawing Sheet

STAPLE REMOVING BIT ESPECIALLY FOR UPHOLSTERY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to staple removing tools, and in particular, to a staple removing bit that can be used with an electric screwdriver, drill or the like, to remove staples from furniture when reupholstering.

As is known, in upholstered furniture, the furniture batting and the covering are often held in place by means of staples. When the furniture is reupholstered, all the staples must be removed. Staple removal is a repetitive, difficult and time consuming task. Numerous tools have been developed to aid in removing staples from furniture. However, most of these tools are manual and hence require repetitive motions by the upholsterer. Further, in some instances, two tools are required to remove the staples.

BRIEF SUMMARY OF THE INVENTION

Briefly stated, an illustrative staple removing tool of the present invention comprises a shaft having a working end at which opposed sloped surfaces are formed, such that the shaft, in side elevation, the working end of the shaft substantially comes to a pointed end.

A generally V-shaped notch is formed at the working end. The notch is formed in the plane of the sloped surfaces, such that the notch extends between the sloped surfaces. The notch comprises opposed and facing inner surfaces that slope inwardly toward each other to form a base of the notch. The notch surfaces increase in width from the end of the shaft to the notch's base. The notch surfaces form an angle with each other of about 10° to about 160°. Illustratively, the surfaces for an angle of about 90°. In addition, the notch surfaces form an angle of about 90° with the sloped surfaces. For a notch having a width of approximately ¼" at the end of the notch, the notch has a depth of about 0.1" from the forward end of the notch to the base of the notch.

Lastly, the tool includes a slot extending axially rearwardly from the apex of the notch. The slot can have a length of about ⅛" to about ½" but may need to be longer in some applications.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
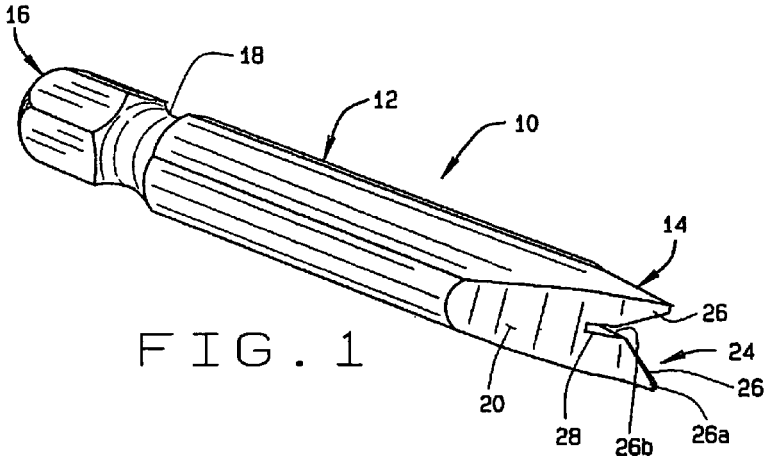
FIG. 1 is a perspective view of an illustrative staple removing tool of the present invention.
Figure 2:
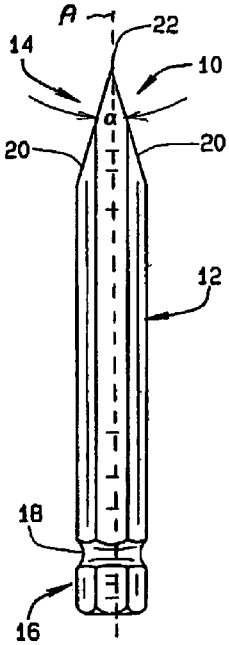
FIG. 2 is a side plan view of the tool.

The following detailed description illustrates the invention by way of example and not by way of limitation. This description will clearly enable one skilled in the art to make and use the invention, and describes what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Although the invention is described for use in removing staples from upholstered furniture, it can be used for other applications as well where staples need to be removed. For example, the invention can be used for staple removal in cardboard boxes, construction materials, electrical applications, carpet removal, etc.

An illustrative embodiment of a staple removing tool or bit 10 is shown generally in the Figures. The tool 10 includes a generally straight shaft 12 defining an axis A and having a first end 14 and a second end 16. The shaft 12 is shown to be hexagonal so that the bit 10 can be received in a power driven handpiece, such as an electric drill or screwdriver, to be rotated about its axis. The bit 10 can also be received in a manual handpiece adapted to receive different bits. Preferably, the shaft 12 is about ¼" to about ⅜" in diameter, so that it can be received in most commercially available drills, bit-receiving screwdrivers and the like. A circumferential groove 18 is formed near the second end 16 of the bit 10 to enable the chuck of a drill to engage the bit 10.

Figure 4:
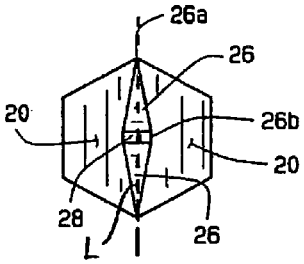
FIG. 4 is an end plan view of the tool, enlarged relative to the drawings of FIGS. 2 and 3.

The first end 14 is the working end of the bit or tool 10. The working end includes opposed sloped surfaces 20 which meet at a tip 22 having a width substantially less than the diameter of the shaft 12. As best seen in FIG. 4. the intersection of the sloped surfaces define an imaginary line L or plane which is substantially aligned with a diameter of the shaft 12 to define a plane of symmetry of for the tool 10, and, the shaft 12 is symmetrical about the imaginary line. Thus, the first end 14 defines a triangle, which may have a very small flat surface at its end. Hence, the tip 22 is substantially pointed. The angle a defined by the sloped surfaces 20 can be as about 10°. As can be appreciated, a sharp angle will facilitate insertion of the forward end of the bit 10 between a staple and the surface in which the staple is inserted easier. However, this angle can vary depending on the application for which the bit will be used.

Figure 3:
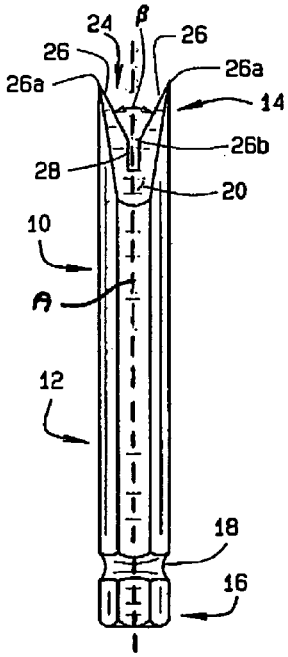
FIG. 3 is a plan view of the tool taken 90° relative to the view of FIG. 2.

A V-notch 24 is formed at the tip 22. The notch 24 is formed in the plane of the surfaces 20. The notch 24 includes inner edges or surfaces 26 which form an angle of about 90° with the sloped surfaces 20. The notch surfaces 26 extend rearwardly and inwardly from a position **26*a* substantially adjacent the outer edge of the bit toward a base 26*b*. Hence, the forward ends 26*a* of the notch define spaced apart points, as best seen in FIG. 3. Because the notch 24 is formed in the plane of the surfaces 20, the edge surfaces 26 of the notch increase in width from their forward ends or points 26*a* to the notch base 26*b*. The surfaces 26 form an angle β of about 10° to about 160°. The depth of the V-notch 24 will vary with the angle formed at 28*b* in relation to the distance between points 26*a* as needed in the best performance for removal of the staple. In one illustrative example, for a ¼" bit, with an angle β of about 90°, the axial depth of the V-notch (from the tip end 26***a* to the notch base 26*b*) is about 0.11" (about 3 mm), the length of the surfaces 26 are about 0.16" to about 0.20" (about 4–5 mm), and the width of the notch between the points 26*a* is about ¼". These dimensions can vary depending on the size of the bit used and the angle β defined by the notch surfaces 26.

A slot 28 extends rearwardly from the notch's apex 26*b*. The slot 28 is generally aligned with the axis of the shaft 12. That is, when viewed in end elevation, as seen in FIG. 4, the slot 28 is located generally centrally of the perimeter of the shaft. The slot 28 is sized to receive the staple being removed. The slot 28 will be at least about ⅛" to about ½" long. However, its length can be longer if necessary to receive a particular type of staple.

In operation, the pointed end 26*a* if the bit 10 is inserted under staple (i.e., between the staple and the wood of the furniture being reupholstered). The bit is then rotated. As the bit is rotated, the staple is wound about the bit and is automatically pulled from the furniture. If for some reason the staple does not come completely out in the first rotation of the bit, the staple is inserted into slot 28 and the bit is rotated again to remove the balance of the staple. Using the bit, the staple is typically removed from the furniture with ¾" of a rotation to one complete rotation of the bit, depending on the staple width and the length of the legs.

As noted above, the bit can be received in an electric drill or screwdriver (which can be corded or cordless). I have found that even cordless screwdrivers, when set to a high torque and low speed setting effectively remove the staple from the furniture. As can be appreciated, when an electric screwdriver or drill is used to rotate the bit, there is very little action required by the furniture refinisher, making removal of staples from the furniture quick and easy.

As various changes could be made in the above construction without departing from the scope of the invention, it is intended that all matter contained in the above description or shown in the accompanying drawings shall be interpreted as illustrative and not in a limiting sense. Although the tool 10 is shown and described as a bit which can be removably received in electric drills, screwdrivers and the like, the tool could also be formed as a single use instrument. That is, the shaft 12 could be an elongate shaft having a handle formed at the end opposite the first end 14. The shaft 12 could be rounded or have any other multi-faceted configuration, as may be desired. The circumferential groove 18 can also be omitted. Although the notch is shown to be V-shaped, it could also be U-shaped. These examples are merely illustrative.

The invention claimed is:

1. A staple removing tool comprising:

a substantially straight body defining an axis about which said body is rotated; said body comprising a shaft having a first end and a second end and a working end extending from said shaft second end; said shaft having an upper portion at said shaft first end and a lower portion; said upper and lower portions being separated by a circumferential groove; at least said shaft upper portion being polygonally shaped to be received in a driver to be rotated by said driver about said axis; said working end comprising a tip of said tool, said tip having opposed sloped surfaces which intersect such that said working end, in side elevation, substantially comes to a pointed end; said intersection of said sloped surfaces defining a line, said line being aligned with a diameter of said shaft and defining a plane of symmetry of said tool;

a notch at said working end tip; said notch being formed in the plane of said sloped surfaces and having a forward end and a base; said notch comprising opposed and facing inner surfaces; said notch inner surfaces increasing in width from the forward end of said notch to said notch base; and a slot extending axially rearwardly from said notch base; said slot being generally aligned with said shaft axis.

2. The staple removing tool of claim 1 wherein said shaft upper portion is hexagonal.

3. The staple removing tool of claim 1 wherein said notch surfaces form an angle with each other of about 10° to about 160°.

4. The staple removing tool of claim 3 wherein said notch surfaces form an angle with each other of about 90°.

5. The staple removing tool of claim 1 wherein said notch surfaces form an angle of about 90° with the sloped surfaces.

6. The staple removing tool of claim 1 wherein said slot has a length of is about ⅛" to about ½".

7. The staple removing tool of claim 1 wherein said notch has a depth of about 0.1".

8. The staple removing tool of claim 1 wherein said notch inner surfaces intersect with a side surface of said tool working end to define a pair of points; said points being in said line defined by the intersection of said sloped surfaces of said working end.

9. The staple removing tool of claim 1 wherein said shaft upper and lower portions are both polygonal in shape.

10. The staple removing tool of claim 9 wherein said shaft upper and lower portions are hexagonal.

11. A staple removing tool comprising:

a generally straight, polygonally-shaped shaft defining an axis about which said shaft is rotated; said shaft comprising an upper portion and a lower portion separated by a circumferential groove; said shaft being adapted to be received in a driver to be rotated by said driver about said axis;

a working portion extending from an end of said shaft and defining a working tip; said working portion tip including opposed sloped surfaces, such that said tip, in side elevation, substantially comes to a pointed end; said sloped surfaces coming to an intersection and defining a line, said line being aligned with a diameter of said shaft and defining a plane of symmetry of said tool;

a notch in said tip; said notch being formed in the plane of said sloped surfaces and having a forward end and a base; said notch comprising opposed and facing inner surfaces; said notch inner surfaces increasing in width from the forward end of said notch to said notch base; said notch inner surfaces defining an angle of about 90° with said sloped surfaces and an angle of about 10° to about 160° with each other; and a slot extending axially rearwardly from said notch base; said slot being generally aligned with said shaft axis.

12. The staple removing tool of claim 11 wherein said notch surfaces form an angle with each other of about 90°.

13. The staple removing tool of claim 11 wherein said slot has a length of about ⅛" to about ½".

* * * * *